US007102076B2

(12) United States Patent
Goehlich

(10) Patent No.: US 7,102,076 B2
(45) Date of Patent: Sep. 5, 2006

(54) WATER SENSING WIRE AND POWER CABLE USING A WATER SENSING WIRE

(75) Inventor: Lothar Goehlich, Berlin (DE)

(73) Assignee: Pirelli Kabel und Systeme GmbH & Co. KG, Berlin (DE)

( * ) Notice: Subject to any disclaimer, the term of this patent is extended or adjusted under 35 U.S.C. 154(b) by 0 days.

(21) Appl. No.: 10/606,861

(22) Filed: Jun. 27, 2003

(65) Prior Publication Data

US 2004/0069048 A1 Apr. 15, 2004

Related U.S. Application Data

(63) Continuation of application No. PCT/EP01/15375, filed on Dec. 28, 2001.

(30) Foreign Application Priority Data

Dec. 28, 2000 (EP) ..... 00128620

(51) Int. Cl.
*H01B 7/34* (2006.01)
*H01B 7/00* (2006.01)

(52) U.S. Cl. ..... 174/36; 174/110 R

(58) Field of Classification Search ..... 174/36, 174/110 R, 113 R, 120 R, 120 AR; 361/103, 361/106

See application file for complete search history.

(56) References Cited

U.S. PATENT DOCUMENTS 4,926,129 A * 5/1990 Wasley et al. ..... 324/555
5,817,974 A * 10/1998 Bovenschen et al. ..... 174/36
5,862,030 A * 1/1999 Watkins et al. ..... 361/103
2003/0098775 A1* 5/2003 Hazard ..... 340/5.8
2003/0201781 A1* 10/2003 McCoy et al. ..... 324/525
2004/0011551 A1* 1/2004 Goehlich et al. ..... 174/74 R

FOREIGN PATENT DOCUMENTS

| | | | |
|---|---|---|---|
| DE | 1490609 A | * | 7/1969 |
| DE | 26 38 609 | | 3/1978 |
| DE | 196 28 702 | | 1/1997 |
| DE | 195 44 391 | | 5/1997 |
| DE | 100 19 430 | | 10/2001 |
| DE | 100 19 707 | | 10/2001 |
| EP | 0 011 754 | | 6/1980 |
| EP | 0 341 933 | | 11/1989 |
| GB | 2 275 555 A | * | 8/1994 |
| JP | 59-171845 A | * | 9/1984 |
| JP | EP 0 341 933 A | * | 5/1988 |
| WO | WO 97/11391 A | * | 3/1997 |

* cited by examiner

*Primary Examiner*—William H. Mayo, III
(74) *Attorney, Agent, or Firm*—Finnegan, Henderson, Farabow, Garrett & Dunner, L.L.P.

(57) ABSTRACT

A water sensing wire for a cable. The water sensing wire has a conductor and a water permeable insulation surrounding the conductor. The conductor is formed by a plurality of metal wires. The water sensing wire may also have a plurality of filaments contained inside the water permeable insulation. Longitudinal and/or radial application of stresses cannot cause damage to the water sensing wire because damage can be avoided by the deformable cross section of the sensor conductor and by the reinforcement provided through the filaments. The water sensing wire is particularly useful in power cables but may also be used in telecommunication cables or optical fibers.

21 Claims, 4 Drawing Sheets

WATER SENSING WIRE AND POWER CABLE USING A WATER SENSING WIRE

CROSS REFERENCE TO RELATED APPLICATIONS

This application is a continuation of international application number PCT/EP01/15375, filed Dec. 28, 2001, the content of which is incorporated herein by reference, and claims the priority of European Patent Application No. 00128620.2, filed Dec. 28, 2000.

BACKGROUND OF THE INVENTION

1. Field of the Invention

The present invention relates to a water sensing wire for a power cable and a power cable using such a water sensing wire. Power cables contemplated by the invention relate generally to the high and extra high voltage range of 40 to 500 kV. However, the present invention may also be applied to power cables in the medium and low voltage range such as 500 V to 40 kV or telecommunications cables.

In power cables water sensing wires are generally used in order to detect a water intrusion into the power cable, something which presents a critical condition for the power cable mechanically as well as electrically. Due to the construction of the power cable the water sensing wire is exposed to various kinds of mechanical influences during the manufacturing of the power cable, during the installment of the power cable in a system and even after many years due to environmental influences such as temperature, vibrations etc., substantially shortening the lifetime of the water sensing wire or substantially decreasing the mechanical and/or electrical properties of the water sensing wire.

The present invention in particular aims at providing a water sensing wire and a power cable having an increased lifetime.

2. Description of the Related Art

FIG. 4 shows a typical example of a conventional power cable PCA comprising one or more water sensing wires WSW. As shown in FIG. 4, the power cable PCA is typically composed of a core consisting of the central conductor PC and an insulation layer PI over which a bedding PBE, the cable screen PSC and the outer sheath PSH are arranged in the stated sequence. Typically, the conductor PC is made of copper, the insulation PI is made of polyethylene, the bedding PBE is made of some kind of semiconductor fabric wrapped around the core PC, PI whilst the screen PSC consists of a plurality of wires, as will be explained below. Thus, the high power cable PCA is surrounded by an insulating and water proof sheath PSH and in many cases this sheath PSH consists even of a double layer of a metal or metal foil layer in combination with an outer layer of plastic (layered sheath).

With such a construction it is hoped that intrusion of water—also in form of water vapor—into the cable core PC, PI can be prevented. The water intrusion leading to so-called "water treeing effects" must be prevented because water accelerates aging processes in the insulation materials of the insulation PI (and the outer sheath PSH) made of cross-linked polyethylene. Therefore, such water intrusion leads to an early failure of the cable.

However, since it cannot be guaranteed that no water intrusion occurs, more recently power cable technology has employed a water intrusion sensing mechanism to be able to at least detect the water intrusion if such water intrusion does occur. Thus, a shutdown of the power cable system or the adjustment of electrical conditions can be performed. Such water intrusion detection mechanisms are also capable of locating the exact position of the water intrusion such that a portion of the cable can be cut out and replaced by a new one if a water intrusion failure occurs.

For this purpose the power cable is equipped with one or more water sensing wires WSW, which are, as shown in FIG. 4, arranged within the cable screen PSC, which itself is grounded at the end and/or beginning of the power cable PCA.

At the beginning or end of the power cable detection circuitry is connected for detecting and locating a water intrusion into the cable. Such detection circuitry is for example disclosed in DE 195 44 391 A1, DE 195 27 172 and EP 0 011 754 by Pirelli Cavi e Sistemi and DE 100 19 707 A1 and DE 100 19 430 A1 of the German company Lancier. In the applications by Pirelli Cavi e Sistemi a single water sensing wire is located in each power cable of a three-phase power transmission system.

As also described in a summary article by L. Goehlich et al. in Elektrizitätswirtschaft, Heft 26, 2000, pages 1–8, the core measurement principle in such water monitoring systems is that a current source feeds a current into the water sensing wire or water sensing wires. In the normal operation condition with no water intrusion there will be no current flow between the water sensing wire and the cable screen PSC, which itself is grounded at the cable beginning or cable end.

However, during water intrusion, as illustrated in FIG. 5, water intrudes into the outer sheath PSH, the cable screen PSC and into the water sensing wire WSW such that a measurement current flows from the water sensing wire through the screen to ground. Performing such a measurement from the cable beginning as well as from the cable end allows that also the location of the failure position can be determined. For further information regarding the water monitoring process, reference is made to the above patent applications and the articles, which are herewith incorporated into the present application via reference.

As illustrated in FIG. 5, typical water sensing wires consist of a conductor WC, for example made of Cu or any other metal, and a water permeable insulation WI surrounding said conductor WC. It should be understood that conventionally the insulation WI tightly fits onto the conductor WC, however, is water permeable in order to allow the aforementioned current flow during a water intrusion. A typical diameter of the water permeable insulation and thus of the water sensing wire WSW is about 1 mm. By means of the water permeable insulation the water sensing wire is electrically insulated from the cable screen PSC in case of no water intrusion whilst in a wet condition the water sensing wire is electrically connected to the cable screen PSC in order to allow the water monitoring measurement.

However, due to the construction of the water sensing wire as shown in FIG. 5 there are certain conditions where the lifetime of a water sensing wire can be reduced. This is due to the arrangement of the water sensing wires in the screen. As shown in FIG. 6, typically the cable screen PSC is provided on the cable core (more precisely on the bedding PBE) and the cable screen PSC consists of a plurality of screen wires, which are wrapped around the bedding PBE in a stranded manner, with a pitch length of about 3 times the core diameter i.e. the screen wires PSC extend substantially parallel. The cable screen wires PSCW typically have a diameter of 0.9 mm and between the cable screen wires PSCW the water sensing wires WSW are arranged. Around this arrangement a type of conducting band PSCB is wrapped under a different wrapping pitch by comparison to the screen wires PSCW in order to contact the individual cable screen wires PSCW to each other.

For mechanical stability and electrical properties the diameter of the central conductor WC of the water sensors is only slightly smaller than the diameter of the adjacent cable screen wires PSCW. Due to the necessary water permeable insulation WI the total outer diameter of the water sensing wire is, however, slightly larger than the diameter of the adjacent screen wires PSCW. Thus, the water sensing wires WSW slightly project from the plane formed by the plurality of power cable screen wires PSCW. Therefore, obviously the conducting holding band PSCB presses onto the water sensing wires at the crossover positions PX shown in FIG. 6.

It is easily understood that during severe external mechanical influences such as deformations, temperature changes etc. the insulation WI of the water sensing wire may be unduly pressed and deformed, in particular at the positions PX, leading to mechanical and/or electrical failure of the water sensing wire. For example, a water intrusion may be detected due to a failure of the water sensing wire insulation WI by contacting the conductor WC to a screen wire PSCW leading to an incorrect detection of water intrusion. Of course, many environmental influences can cause such a reduced lifetime of the water sensing wire, because even when all conditions are appropriately set during the manufacturing of the power cable, over some time later the material of the insulation may become brittle leading to a deterioration of the insulation and consequently to mechanical and/or electrical failure.

Whilst the major impact of compressing the insulation is in the radial direction, also stresses in the longitudinal direction of the water sensing wire WSW can cause a failure. FIG. 3 shows the deformation (stretching) of a conductor made of Cu and an insulation made of polyester of a water sensing wire WSW according to the prior art (①). Since the conventional combination of the Cu conductor WC and the insulation WI made of polyester, the Cu conductor WC is subjected to a plastic deformation whilst the insulation WI is still subjected to an elastic deformation when a stretching force $F_o$ in the longitudinal direction is applied. If the force is again reduced the polyester insulation WI shrinks and bends the excess length of the plastically deformed Cu conductor WC within the polyester insulation WI. This can lead to a loop in the Cu conductor WC and this conducting loop of Cu can penetrate through the insulation WI and can thus make contact with the screen wires PSCW. This leads to fatal damage of the water sensing wire and to an incorrect detection of water intrusion.

SUMMARY OF THE INVENTION

As explained above, in conventional power cables equipped with a water monitoring system radial and longitudinal stresses applied to the water sensing wire insulation may lead to damage of the water monitoring system and therefore to an incorrect water intrusion detection, i.e. the reduced operable lifetime of the water sensing wire.

Thus, the object of the present invention is to provide a water sensing wire and a cable using such a water sensing wire having extended lifetime.

This object is solved by a water sensing wire for a power cable comprising a conductor and a water permeable insulation surrounding said conductor, wherein said conductor is formed by a plurality of metal wires.

Furthermore, this object is also solved by a cable comprising one or more water sensing wires as defined above provided in a screen thereof.

According to a first aspect of the invention, the conductor of the water sensing wire is formed by a plurality of metal wires provided inside the water permeable insulation. The water permeable insulation is a type of ring structure surrounding the plurality of wires and therefore, when a radial pressure is applied to the insulation, the individual wires can move, i.e. change their total cross-sectional shape, whilst they maintain their electrical cross-section necessary for flowing sufficient current. Thus, pressures like for example from the mounting band of the power cable, cannot cause a damage in the water sensing wire thus leading to increased lifetime of this type of wire.

According to a second aspect of the invention one or more polymer filaments can be contained inside the water permeable insulation as longitudinal reinforcement. The polymer filaments are preferably substantially parallel to the conductor, i.e. they are not stranded. Therefore, the lifetime of the water sensing wire can also be increased because longitudinal stresses do not lead to the formation of loops, which can penetrate to the insulation and contact wire screen wires as in the prior art.

According to a third aspect of the invention the water sensing wire comprises the conductor and a water permeable insulation surrounding said conductor, wherein said conductor is formed by a single metal wire and one or more polymer filaments surrounded by the water permeable insulation. This type of water sensing wire can comprise one or more filaments and therefore has an improved stress performance with respect to longitudinal stresses.

According to a fourth aspect of the invention the polymer filaments and the conductor have an elasticity module such that up to a limit force at which an elastic deformation of that polymer filaments changes into a plastic deformation, only an elastic deformation is applied to said conductor. Therefore, in accordance with the combination of the conductor material, for example Cu, the insulation material, e.g. polyester, and the polymer filaments, a plastic deformation of the conductor is avoided such that no loops can be formed even after removal of the longitudinal stresses. This drastically increases the lifetime of the water sensing wire, which has been confirmed in fatigue tests.

Further advantageous embodiments and improvements of the invention are listed in the attached claims. Furthermore, it should be noted that the invention is not restricted to the features listed in the claims and the description and that further embodiments comprise features, which have been independently listed in the description and the claims.

Hereinafter, the embodiments of the invention will be described with reference to the drawings.

BRIEF DESCRIPTION OF THE DRAWINGS

In the drawings the same or similar reference numerals designate the same or similar parts throughout.

In the drawings

Figure 1:
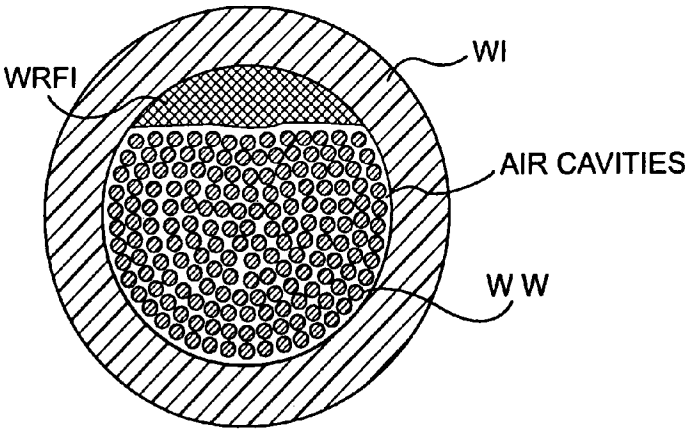
FIG. 1 is a cross-sectional view of a water sensing wire WSW in accordance with the invention.

It should be noted that hereinafter in the drawings and in the description some reference will be made to some well-known materials in cable construction such as aramid and Kevlar®, which is a registered trademark of Hoechst and Du Pont.

DETAILED DESCRIPTION OF THE INVENTION

Figure 2:
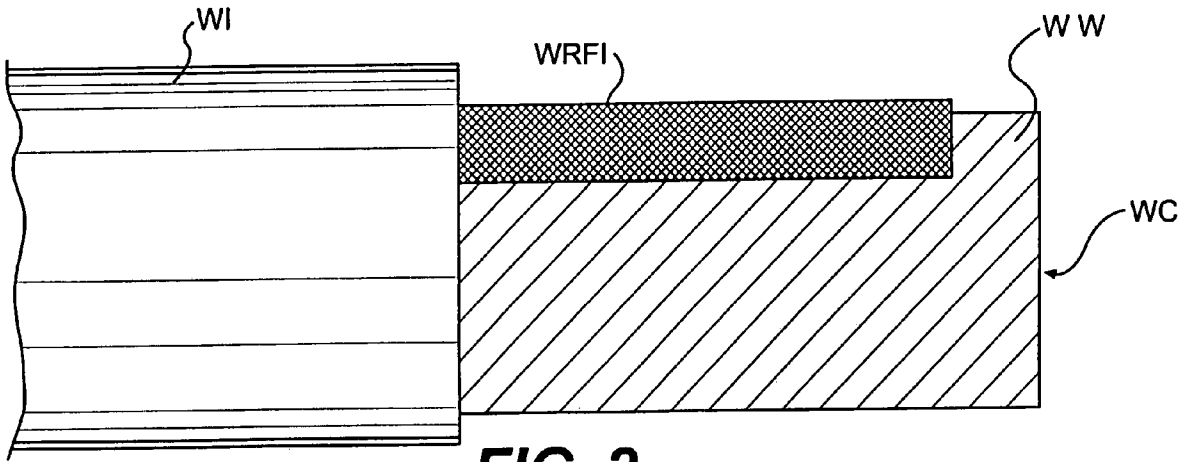
FIG. 2 is a side view of a water sensing wire WSW as shown in FIG. 1, in accordance with the invention.
Figure 5:
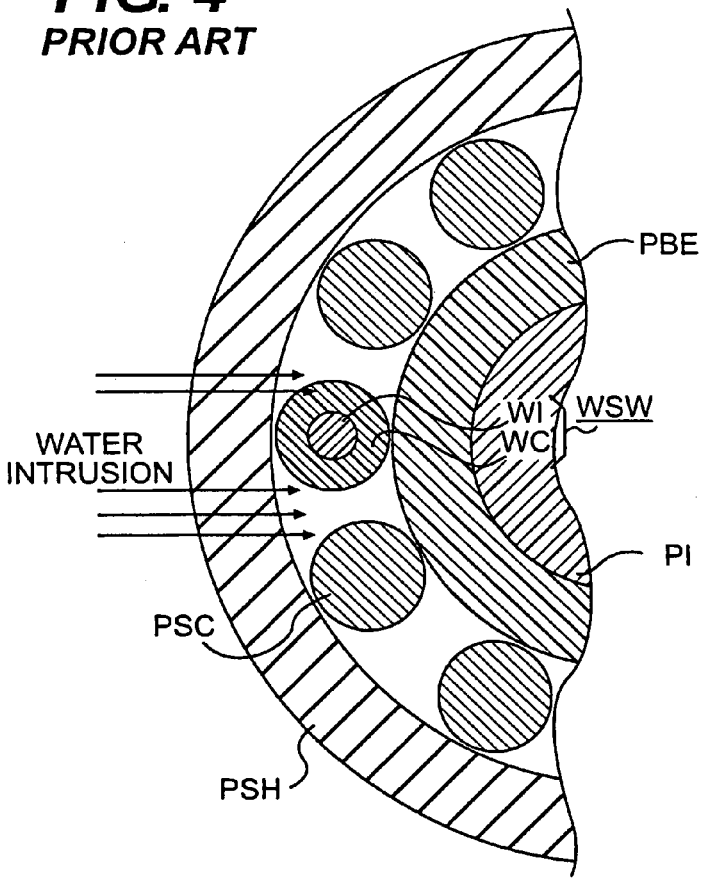
FIG. 5 shows how a water intrusion takes place in the power cable as shown in FIG. 4.

As shown in FIG. 1 and FIG. 2, which show the water sensing wire WSW in accordance with the invention, by contrast to the water sensing wire WSW shown in FIG. 5, the water sensing wire WSW in accordance with the invention comprises, instead of the solid conductor WC shown in FIG. 5, a conductor WW, which is formed by a plurality of metal wires WW. The conductor wires WW are provided inside the water permeable insulation WI, which is provided as a kind of layer or sheath around the wires WW. Depending on the size of the conductor wires WW, wherein a typical size is 0.05 mm–0.5 mm and preferably 0.1–0.2 mm, there are provided some air cavities between the wires. However, most importantly the formation of the conductor portion WC of the water sensing wire WSW by a plurality of metal wires WW causes an effect that the plurality of wires can move, i.e. change their overall cross-sectional shape, during an application of a radial pressure or stress onto the insulation WI. Thus, there will be no damage of the conductor or insulation during radial pressures.

Figure 6:
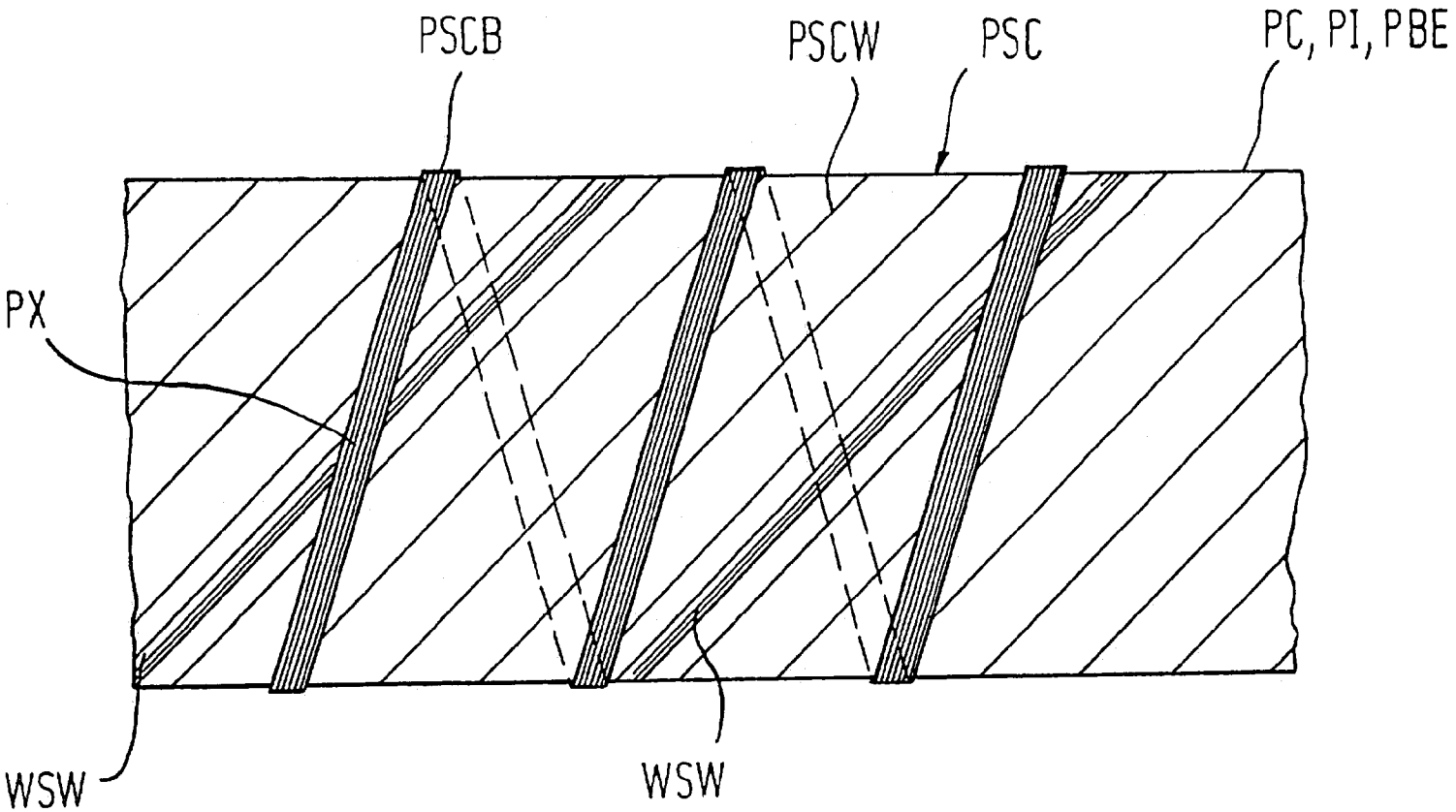
Fig. 6 PRIOR ART
FIG. 6 shows the arrangement of the cable screen PSC with its cable screen wires PSCW and a conducting band PSCB.

As shown in FIG. 2, the plurality of wires WW are preferably stranded in accordance with a predetermined length of a stranding pitch PWL and a direction of a stranding pitch PWD. Such a conductor formed by a plurality of stranded wires is for example a Litz-wire. Important in this arrangement is that the conductor WW is essentially formed to have a variable cross section during the application of a radial pressure and this is for example not the case with the solid conductor WC shown in FIG. 5 of the prior art. Thus, the present invention contemplates all water sensing wire conductors, which are embodied in such a way that they can change their cross-sectional shape during the application of pressure such that no damage occurs to the water sensing wire for example due to the rapping of the conducting band PSCB as shown in FIG. 6. Whilst the water sensing wire conductor changes its cross-sectional shape it maintains its cross-sectional and longitudinal surface area and therefore there is only a mechanical deformation but no impact on the electrical properties, i.e. on the conductor resistance and break down voltage of insulation.

Typically, the plurality of wires WW. forming said conductor WC can be Cu wires wherein the material of the water permeable insulation can be polyamid or polyester.

As explained above, already the provision of a conductor having a variable cross-section during the application of a radial pressure, for example such a conductor being imposed of a plurality of thin wires, increases the lifetime of the water sensing wire since radial pressures cannot cause any damage in the water sensing wire and thus in the insulation WI.

To also endure longitudinal stress application, preferably a plurality of filaments WRFI are contained within the water permeable insulation WI, as shown in FIG. 1 and in FIG. 2. It is important to note that the filaments WRFI are substantially parallel to the conductor WC, i.e. to the plurality of wires WW, and the filaments are not stranded. The one or more filaments WRFI can be made of a polymer, for example polyester, Aramid® or Kevlar® (Aramid and Kevlar are trademarks of Hoechst and Du Pont and the materials of which they consist are Poly(1,4-Phenylenterephthalamid). As shown in FIG. 2, the reinforcement filaments WRFI are not stranded with the wires WW and thus the sensor conductor WC has an increased strength in the longitudinal direction, which not only simplifies the production and processing when installing the cable but also increases the lifetime since longitudinal stress application cannot form a drastic damage to the conductor core wires WW.

As shown in FIG. 1 and in FIG. 2, the placement of the reinforcement filaments WRFI and the plurality of wires WW is performed in such a manner that some air cavities are formed between the filaments and the wires inside the insulation layer or insulation ring WI. A preferential material for the insulation tube WI is polyester or polyamide. Preferably, the insulation WI is constituted, as shown in FIG. 2, as an insulating braiding WBRA.

The conductor wires WW and the filaments WRFI may be arbitrarily distributed within the insulation tube WI as long as they allow a cross-sectional deformation during the application of radial pressure. Thus, the conductor WC consisting of the plurality of wires WW may be arranged only at one particular position, as shown in FIG. 1, however, they may also be placed at several positions co-locating some wires. It is also possible to evenly distribute them amongst the filaments WRFI. Independent of the location of the wires WB and the filaments WRFI, a preferred ratio of the total cross-sectional area of the wires WW (i.e. the total cross-section of the conductor WC) to the total cross-section of all filaments WRFI (i.e. the total cross-sectional area of the reinforcement) may be in the range between 4–1.

At the water sensing wire beginning or water sensing wire end, the plurality of wires WW are connected together and also the filaments WRFI are connected together, respectively, such that the current can be passed through all wires WW and that a substantially common reinforcement rod is obtained.

By arranging the plurality of wires WW and, the plurality of filaments WRFI as shown in FIG. 1 and FIG. 2 the damaging problem caused by radial pressure (e.g. by the contacting band) and longitudinal stress (for example during installment) can be solved such that the concept of a rigid and mechanically stable sensor conductor together with a compressible and mechanically sensitive insulation can be disposed with.

For increasing the tensile strength of the water sensing wire and for avoiding a plastic deformation of the metal conductor WC under mechanical stress below the value where a breakage occurs, the sensor conductor WC has the polymer reinforcement made of a plurality of filaments WRFI. The polymer filaments WRFI have a smaller cross-section than the sensor conductor PC and do not obstruct the deformation of the cross-sectional shape of the sensor conductor WC under radial pressures.

Figure 3:
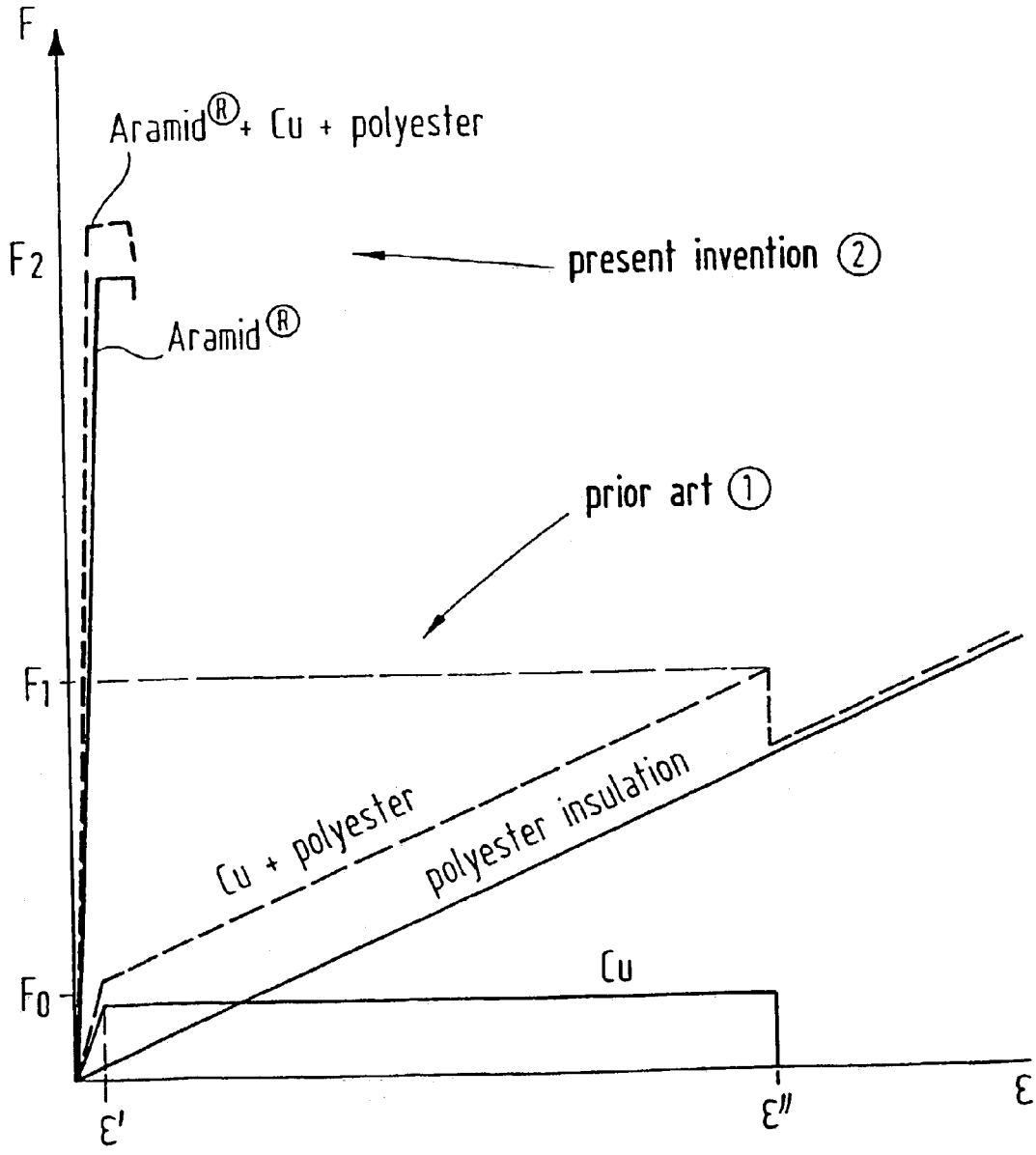
FIG. 3 is a deformation diagram comparing deformation results of a conventional water sensing wire ① and of a water sensing wire in accordance with the present invention ②.
Figure 4:
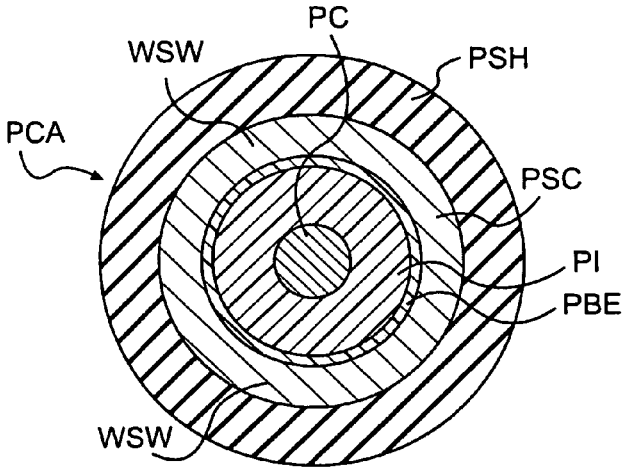
FIG. 4 PRIOR ART
FIG. 4 shows a typical construction of a power cable PCA.

Finally, FIG. 3 shows a deformation stress diagram comparing results of the present invention with results of the prior art. In particular, FIG. 3 shows schematically the elongations $\epsilon$ when different (longitudinal) forces are applied to the inventive water sensing wire WSW shown in FIG. 1. As shown in FIG. 3 a metal conductor PC for example made of Cu has a substantial linear stretching with respect to an applied force F up to the stretching limit value $\epsilon'$. From this point onwards the elastic deformation changes into a plastic deformation until the conductor breaks at $\epsilon''$. By contrast, due to the different material of polyester for the insulation, the insulation substantially still has an elastic deformation up to very large forces $F_1$.

On the other hand, a reinforcement rod made of the Aramid® or Kevlar® filaments have substantially no stretching up to a very large force. Therefore, even when the force is reduced from for example $F_2$ to $F_1$ and $F_0$ there is no formation of loops of the wires of the conductor WC, because there is only an elastic deformation for forces smaller than $F_2$. Thus, there can be no insulation failures even if the application over longitudinal stress is removed.

Thus, the combination of the filaments WRFI and the conductor wires WC has an elasticity module such that up to a limit force $F_2$, at which an elastic deformation of the filaments changes into a plastic deformation, only an elastic deformation is applied to the conductor WC. Therefore, no insulation failure can exist.

Thus, the different aspects of the invention, namely the provision of a water sensing wire conductor WC having a deformable cross-section (for example formed by a plurality of wires, e.g. stranded wires), the second aspect of providing reinforcement filaments WRFI inside the insulation sheath WI, and the third aspect of the invention of constituting the insulation WI as an insulating braiding, each allow to solve the aforementioned object of the invention, namely the increasing of the lifetime of the water sensing wire. This is substantially obtained by the fact that a radial application of force or a longitudinal application of a force cannot damage the conductor WC or the insulation WI.

Therefore, a further aspect of the invention is a water sensing wire as in principle shown in FIG. 1, comprising a conductor WC and a water permeable insulation WI surrounding said conductor WC. According to the third aspect the conductor is a single metal wire WW whereas one or more polymer filaments WRFI are contained with the water permeable insulation which is again formed as a type of surrounding ring surrounding the single metal wire, for example arranged in the center, and the one or more polymer filaments WRFI. It may also be arranged in such a manner as shown in FIG. 5, i.e. a single wire WC surrounded by an insulation WI whereas the reinforcement filament or reinforcement filaments are provided within the insulation WI. Such a wire also has for the water sensing measurements an improved behavior with respect to longitudinal stresses.

Thus, this concept of the present invention can be applied to all water sensing wires in all types of cables in which a radial or longitudinal application of force can cause a damage in the cable. Thus, the power cable is only one application example and the inventive principle may be applied equally well to telecommunication cables, optical cables etc.

Furthermore, it should be noted that the present invention comprises further modifications and variations on the basis of the teachings above. In particular, the present invention may comprise features which have been separately described and claimed in the claims and in the description. Furthermore, what has been described above is only what the inventor presently conceives as the best mode of the invention and further embodiments may be devised on the basis of the above disclosure.

In the claims reference numerals have only been added for clarification purposes and the reference numerals do not in any way limit the scope of protection of these claims as defined therein.

What is claimed is:

1. A cable having a screen, said screen comprising a water sensing wire, said water sensing wire comprising:

a) a conductor; and b) a water permeable insulation surrounding said conductor; wherein c) said conductor is formed by a plurality of metal wires with air cavities between the plurality of metal wires, the air cavities configured to allow the cross-sectional shape of the conductor to change when a radial pressure is applied to the insulation.

2. The cable according to claim 1, wherein said plurality of wires are stranded according to a predetermined length of pitch and direction of pitch.

3. The cable according to claim 1, wherein said conductor is a Litz-wire.

4. The cable according to claim 1, wherein one or more polymer filaments are contained as reinforcement inside said water permeable insulation.

5. The cable according to claim 4, wherein said polymer filaments are substantially parallel to said conductor.

6. The cable according to claim 4, wherein said polymer filaments are made of Aramid or Kevlar.

7. The cable according to claim 4, wherein said polymer filaments and said conductor have an elasticity module such that up to a limit force at which an elastic deformation of said polymer filaments changes into a plastic deformation, only an elastic deformation is applied to said conductor.

8. The cable according to claim 1, wherein said water permeable insulation comprises insulating braiding.

9. The cable according to claim 8, wherein said insulating braiding is made of polyester or polyamide.

10. The cable according to claim 1, wherein said plurality of wires forming said conductor are copper wires.

11. The cable according to claim 1, wherein said cable is a power cable.

12. The cable according to claim 1, wherein a plurality of reinforcement filaments are provided inside said insulation.

13. A cable having a screen, said screen comprising a water sensing wire, said water sensing wire comprising:

a) a conductor; and b) a water permeable insulation surrounding said conductor;

c) said conductor comprising a variable deformation cross section during application of radial stress.

14. The cable according to claim 13, wherein said conductor is formed by a plurality of metal wires having air cavities therebetween.

15. The cable according to claim 14, wherein a plurality of reinforcement filaments are provided inside said insulation.

16. The cable according to claim 13, wherein a plurality of reinforcement filaments are provided inside said insulation.

17. The cable according to any one of claims 16, 15 or 12, wherein said metal wires and said reinforcement filaments are arranged such that air cavities are formed between said metal wires and said reinforcement filaments.

18. A water sensing wire for a cable, comprising:

a) a conductor; and b) a water permeable insulation surrounding said conductor; wherein c) said conductor is formed by a plurality of metal wires with air cavities between the plurality of metal wires, the air cavities configured to allow the cross-sectional shape of the conductor to change when a radial pressure is applied to the water permeable insulation; and wherein further d) said water sensing wire comprises one or more reinforcement filaments radially internal with respect to an internal radius of said water permeable insulation.

19. A water sensing wire for a cable comprising:

a) a conductor; and b) a water permeable insulation surrounding said conductor;

c) said conductor comprising a variable deformable cross section during application of radial stress;

d) said water sensing wire comprising one or more reinforcement filaments radially internal with respect to an internal radius of said water permeable insulation.

20. A cable having a screen, said screen comprising a water sensing wire, said water sensing wire comprising:

a) a conductor;

b) a water permeable insulation surrounding said conductor; wherein c1) said conductor is a single metal wire; and c2) one or more reinforcement filaments are provided radially internal with respect to said water permeable insulation.

21. A water sensing wire for a cable comprising:

a) a conductor;

b) a water permeable insulation surrounding said conductor; wherein c1) said conductor is a single metal wire; and c2) one or more reinforcement filaments are provided radially internal with respect to an internal radius of said water permeable insulation.

* * * * *